United States Patent [19]

Mignano

[11] 3,933,350

[45] Jan. 20, 1976

[54] PAPER INSERT FEEDER

[76] Inventor: Frank J. Mignano, 293 8th St., Brooklyn, N.Y. 11215

[22] Filed: Dec. 9, 1974

[21] Appl. No.: 530,755

[52] U.S. Cl. ..... 271/10; 271/37; 271/114; 271/125; 271/165

[51] Int. Cl.[2] ..... B65H 3/06; B65H 5/04

[58] Field of Search ..... 271/10, 37, 110, 111, 114, 271/121, 124, 125, 165

[56] References Cited

UNITED STATES PATENTS

| | | | |
|---|---|---|---|
| 2,359,856 | 10/1944 | Morse | 271/125 |
| 2,670,954 | 3/1954 | Bach | 271/124 |
| 3,612,511 | 10/1971 | Godlewski | 271/110 |

*Primary Examiner*—Robert S. Ward, Jr.
*Assistant Examiner*—Robert Saifer
*Attorney, Agent, or Firm*—Peter L. Tailer

[57] ABSTRACT

Paper inserts, such as statements, payroll checks, and the like, are stacked on the downward sloping bottom of a hopper behind inward extending front stop plates that form a clearance over the hopper bottom. A pair of pinch rollers are constantly driven in front of the stop plates to pass on inserts delivered thereto. At least one front feed roller is disposed substantially below the stop plates and two rear feed rollers are disposed behind the stop plates. The front and rear feed rollers are of resilient material and project upward above the bottom of the hopper. A cylindrical gate is adjustably positioned above the front feed roller so that an intermittent rotation of the feed rollers advances the lowermost insert of the stack under the gate to be engaged by the pairs of constantly driven pinch rollers.

5 Claims, 7 Drawing Figures

PAPER INSERT FEEDER

BACKGROUND OF THE INVENTION

Insert machines that insert statements, checks, folded letters, or the like into envelopes conventionally have a feeder which requires a pile of inserts to be slipped forward with what is known as "shingling" so that the front edge of the uppermost insert rests against the bottom of the hopper. An upper intermittently driven roller draws off and feeds the topmost check each time it is rotated. The stacking of "shingled" inserts is time consuming as top fed insert feeders must have additional loadings of inserts placed under and behind those remaining in the hopper of the feeder. Further, top fed insert feeders often mis-align and mangle multi-leaf inserts such as checks or statements with attached additional leaves or parts. The insert feeder of this invention provides for the more effective and easier bottom feeding of inserts from its hopper.

DESCRIPTION OF THE PREFERRED EMBODIMENT

Figure 1:
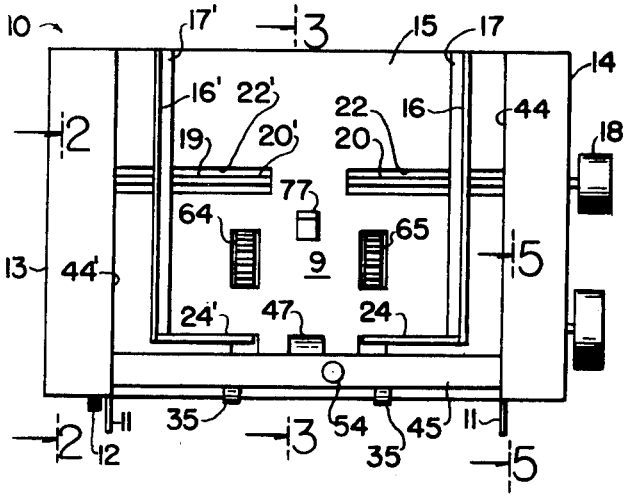
FIG. 1 is a top view of a paper insert feeder according to my invention.

As shown in FIG. 1, the paper insert feeder 10 of this invention is fixed to a conventional envelope stuffing machine (not shown) by means of forward projecting hooks 11. A constantly driven gear on the envelope stuffing machine meshes with and drives the projecting gear 12 constantly while feeder 10 is being used. Referring additionally to FIGS. 2–5, feeder 10 has two rectangular side covers 13 and 14 between which there is disposed a forwardly sloping bottom plate 15 of insert hopper 9.

Figure 2:
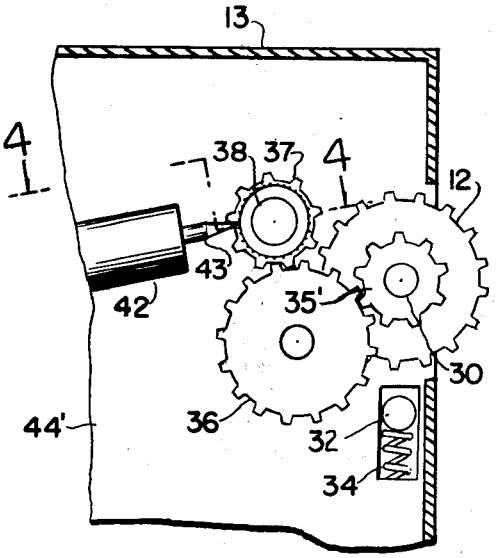
FIG. 2 is a section taken on line 2—2 of FIG. 1 through a fragment of the feeder.
Figure 3:
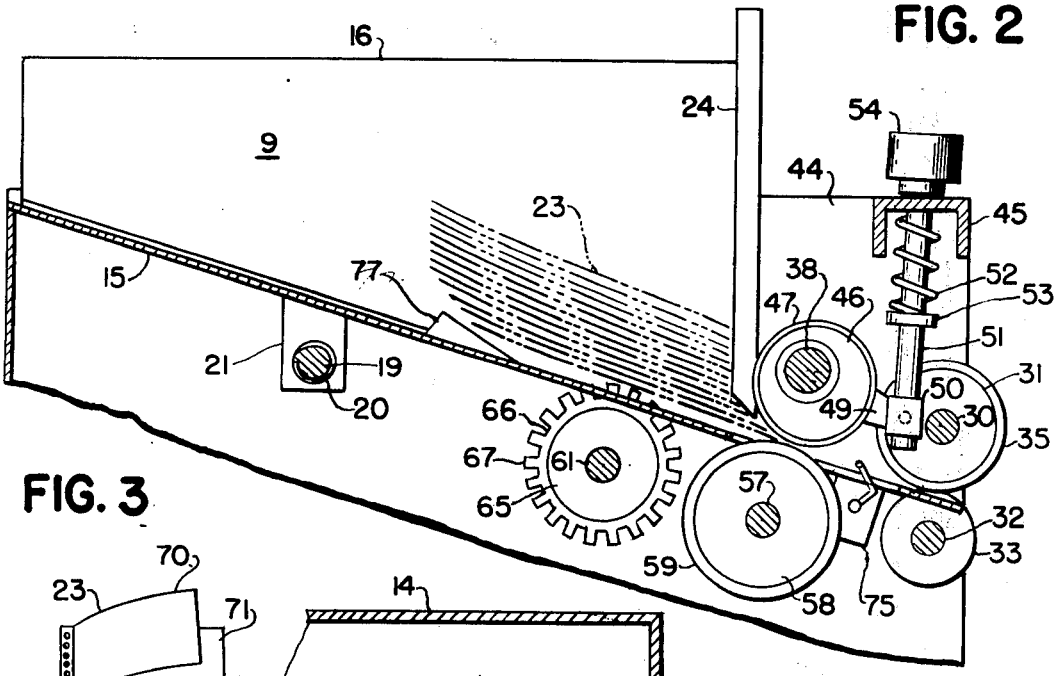
FIG. 3 is a section taken on line 3—3 of FIG. 1 through a broken away upper portion of the feeder.

As may be seen in FIGS. 1–3, side plates 16 and 16′ with inwardly extending bottom flanges 17 and 17′ are disposed on the sloping bottom plate 15. A nob 18 is fixed on shaft 19 which has right and left hand threaded portions 20 and 20′. The threaded portions 20 and 20′ extend through and engage downward extensions 21 of the side plates 16 and 16′. The downward extensions 21 project through lateral slots 22 and 22′ in the sloping bottom plate 15. The rotation of nob 18 thus adjusts the spacing of side plates 16 and 16′ to receive a pile of paper inserts 23 therebetween. Front stop plates 24 and 24′ are fixed to extend inward from the front ends of side plates 16 and 16′ with a clearance over the front end of bottom plate 15.

Referring further to FIGS. 1–5, driven gear 12 is mounted on shaft 30 which extends over the front of bottom plate 15 and mounts a constantly driven pair of rollers 31. A shaft 32 below shaft 30 mounts a second pair of rolles 33. Spring mountings 34 at the ends of shaft 32 urge the rollers 33 against the rollers 31 to form a co-acting pair of constantly driven rollers. Rollers 31 are preferably covered with a layer 35 of resilient material.

Figure 4:
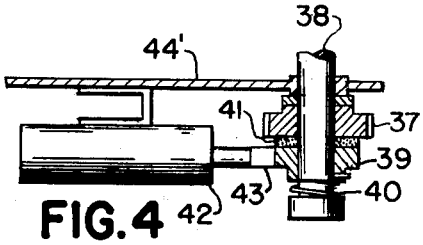
FIG. 4 is a section taken on line 4—4 of FIG. 2.

Referring to FIG. 2, a small spur gear 35′ on shaft 30 drives an idler gear 36 which, in turn, drives gear 37. As shown in FIG. 4, gear 37 is rotatably mounted on shaft 38. A serrated disk 39 is keyed to shaft 38 and is urged by a spring 40 against a clutch plate 41 so that the shaft 38 is driven by gear 37 through clutch plate 41. A solenoid 42 activates a locking member 43 that engages the serrations on the edge of disk 39 to stop its rotation and thereby the rotation of shaft 38. In this manner as solenoid 42 is activated to release and then lock disk 39, gear 37 intermittently drives shaft 38.

Shaft 38 is journalled between sides 44 and 44′ and an upper cross member 45 extends between sides 44 and 44′ above it. An eccentrically mounted disk 46 allows shaft 38 to rotate freely within it so that shaft 38 serves as a mounting for the cylindrical gate 47 formed by a resilient covering on disk 46. An arm 49 is connected to a nut 50 turned onto threaded shaft 51. Shaft 51 extends downward from member 45 and is positioned by a spring 52 and a collar 53 and capped by a gate adjustment nob 54 above member 45. The rotation of nob 54 vertically positions gate 47.

Figure 5:
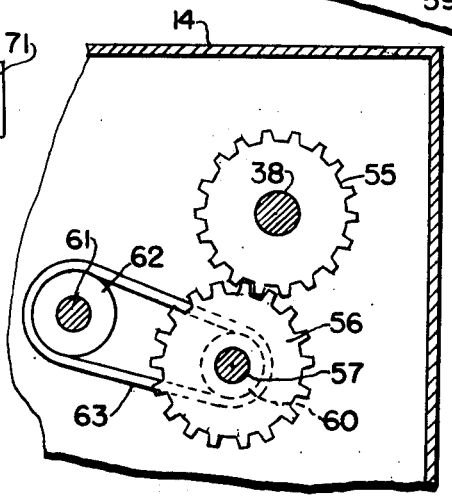
FIG. 5 is a section taken on line 5—5 of FIG. 1.

As may be seen in FIG. 5, shaft 38 mounts a spur gear 55 within side cover 14. Spur gear 55 meshes with and drives gear 56 mounted on shaft 57 which extends under bottom plate 15 and mounts front feed roller 58 covered with resilient material 59. As may be seen in FIG. 3, front feed roller 58 is disposed directly below gate 47. The clearance between front feed roller 58 and gate 47 is set by means of nob 54.

Referring further to FIG. 5, shaft 57 mounts a pulley 60 outside gear 56. By means of a belt 63 and a pulley 62 mounted on a shaft 61, shaft 57 drives shaft 61. As may be seen in FIGS. 1 and 3, shaft 61 mounts the rear feed rollers 64 and 65 which project upward through openings in bottom plate 15. Rollers 64 and 65 are best made with a resilient, soft rubber cover 66 having closely spaced radial projections 67.

Figure 6:
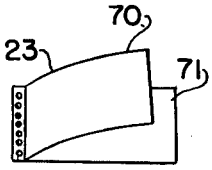
FIG. 6 is a perspective view of a payroll check and a partly opened attached form which is one type of paper insert fed by the device of this invention; and, FIG. 7 is a longitudinal, vertical section through a fragment of the bottom of the hopper of the feeder showing a magnetically attached insert lift fixed thereto.

FIG. 6 shows a paper insert 23 which could be a check 70 having an attached statement 71. As shown in FIG. 3 in phantom lines, the inserts 23 are placed in feeder 10 in the hopper 9 formed by the sloping bottom plate and the sides 16 and 16′. The inserts 23 rest against the front stop plates 24 and 24′ and the sides 16 and 16′ are moved up to the ends of the inserts 23 by turning nob 18 as shown in FIG. 1.

When an insert 23 is to be fed, solenoid 42 releases serrated disk 39 so that shaft 38 is driven counterclockwise as shown while shafts 57 and 61 are driven clockwise. The rear feed rollers 64 and 65 advance the lowermost insert 23 between front feed roller 58 and gate 47. A careful vertical adjustment of gate 47 allows it to stop and hold all but the lowermost insert which is advanced between the constantly driven pairs of pinch rollers 31 and 33. On the passage of the lowermost insert 23, a switch 75 causes selenoid 42 to again move locking element 43 to engage the serrated disk 39 and stop the rotation of shafts 38, 57, and 61 and the front feed roller 58 and the rear feed rollers 64 and 65. When another insert is to be fed, the feeder 10 repeats the operation. The electrical circuitry connecting solenoid 42 and switch 75 to a sensing switch (not shown) in the stuffer to activate feeder 10 is well known.

Figure 7:
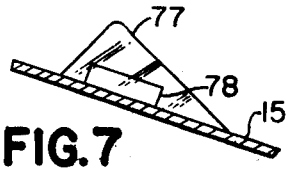

Some inserts 23 feed better if an insert lift 77, as shown in FIGS. 3 and 7, is fixed to the bottom of the hopper 9 on plate 15. The insert lift 77 is a small plastic wedge that may be held to the bottom plate 15 by means of an embedded magnet 78, two sided sticking tape, or any other suitable means. Insert lift 77 throws the weight of the inserts 23 forward enough so that the lowermost insert is sure to be advanced by the rear feed rollers 64 and 65.

While this invention has been shown and described in the best form known, it will nevertheless be understood that this is purely exemplary and that modifications may be made without departing from the spirit of the invention.

I claim:

1. A feeder for paper inserts comprising, in combination, a. a hopper having a forward sloping bottom plate, sides extending upward from said bottom plate and having front ends, and front stop plates extending inward from the front ends of said sides with a clearance over said bottom plate;

b. a first driven shaft;

c. at least two first rollers mounted on said first shaft;

d. a second spring mounted shaft;

e. second rollers mounted on said second shaft contacting said first rollers forming at least a pair of driven pinch rollers at the front of said bottom plate;

f. a third shaft extending across said hopper above said bottom plate in front of said front stop plates;

g. first transmission means enabling said first shaft to intermittently drive said third shaft;

h. a fourth shaft mounted below said bottom plate substantially under said front stop plates;

i. at least one front feed roller mounted on said fourth shaft, said bottom plate containing a first opening through which said at least one front feed roller projects;

j. gate means disposed in front of said front stop plates above said at least one front feed roller;

k. adjustment means positioning said gate means a distance over said at least one front feed roller to permit passage therebetween of a single paper insert;

l. a fifth shaft journalled behind said fourth shaft below said bottom plate;

m. second transmission means connecting said third shaft to said fourth and fifth shafts so that said third shaft drives said fourth and fifth shafts; and n. at least one pair of rear feed rollers mounted on said fifth shaft, said bottom plate containing second openings through which said rear feed rollers project, said paper inserts being stacked in said hopper between said sides against said front stop plates and resting at least partially on said at least one pair of rear feed rollers, said first transmission means intermittently driving said third shaft and thereby said front and rear feed rollers advancing a lowermost paper insert into said at least one pair of pinch rollers.

2. The combination according to claim 1 wherein said gate is a disk having a resilient cover, said disk being eccentrically mounted on said third shaft with said third shaft turning freely therein; and wherein said adjustment means positioning said gate over said at least one feed roller is an arm extending from said eccentrically mounted disk, and means adjustably positioning said arm.

3. The combination according to claim 2 wherein said means positioning said arm is a nut fixed on said arm, a longitudinally fixed threaded shaft engaged by said nut, and an adjustment nob on said threaded shaft to rotate said threaded shaft positioning said gate over said front feed roller.

4. The combination according to claim 3 wherein said first transmission means comprises a first spur gear fixed on said first shaft, an idler gear driven by said first spur gear, a second spur gear driven by said idler gear and being rotatably mounted on said third shaft, slip clutch means through which said second spur gear drives said third shaft, a serrated disk mounted on said third shaft, and solenoid operated means engaging said serrated disk arresting said disk slipping said clutch means and intermittently stopping said third shaft.

5. The combination according to claim 4 wherein said second transmission means is a third spur gear fixed on said third shaft, a fourth spur gear fixed on said fourth shaft engaging said third spur gear, a first pulley on said fourth shaft, a second pulley on said fifth shaft, and a belt connecting said pulleys, said fourth shaft driving said fifth shaft thereby.

* * * * *